US007241250B1

(12) United States Patent
French et al.

(10) Patent No.: US 7,241,250 B1
(45) Date of Patent: Jul. 10, 2007

(54) HYDROTHERAPY AND EXERCISE DEVICE WITH INTEGRATED LIFT AND TREADMILL MEANS

(75) Inventors: Jay French, Elizabethtown, PA (US); Roy Janson, Clarks Summit, PA (US)

(73) Assignee: Hydroworx, Middletown, PA (US)

( * ) Notice: Subject to any disclaimer, the term of this patent is extended or adjusted under 35 U.S.C. 154(b) by 0 days.

(21) Appl. No.: 08/884,546

(22) Filed: Jun. 27, 1997

Related U.S. Application Data

(63) Continuation of application No. 08/884,546, filed on Jun. 27, 1907, which is a continuation of application No. 08/432, 280, filed on May 1, 1995, now abandoned.

(51) Int. Cl.
*A63B 22/00* (2006.01)
A63B 21/00

(52) U.S. Cl. ..... 482/54; 482/51

(58) Field of Classification Search ..... 482/54, 482/51, 111; 187/269, 255
See application file for complete search history.

(56) References Cited

U.S. PATENT DOCUMENTS

| | | | | | |
|---|---|---|---|---|---|
| 3,935,600 | A | * | 2/1976 | Scribner | 482/269 |
| 4,918,766 | A | * | 4/1990 | Leonaggeo, Jr. | 482/54 |
| 4,938,469 | A | * | 7/1990 | Crandell | 482/54 |
| 5,108,088 | A | * | 4/1992 | Keller et al. | 482/54 |
| 5,314,391 | A | * | 5/1994 | Potash et al. | 482/54 |

* cited by examiner

*Primary Examiner*—Glenn Richman
(74) *Attorney, Agent, or Firm*—Bruce J. Clark

(57) ABSTRACT

A hydrotherapy and exercise device is disclosed with integrated lift and treadmill means, having a tank for retaining fluid, treadmill means having driving means for rotating the treadmill and having at least one flexible linkage having two ends about which the linkage rotates, end lift means for lifting the treadmill and having at least two rigid supporting members pivotally connected at a pivot point wherein one end of the treadmill driving means rotates about the pivot point, and having remote control, electrically isolated microprocessor means for controlling the level of the treadmill, speed of the treadmill, flow rate of water and chemistry of the water in response to electrical information received from respective monitoring means.

5 Claims, 8 Drawing Sheets

HYDROTHERAPY AND EXERCISE DEVICE WITH INTEGRATED LIFT AND TREADMILL MEANS

This application is a continuation of application Ser. No. 08/884,546, filed Jun. 27, 1997, which is a continuation of application Ser. No. 08/432,280, filed May 1, 1995, now abandoned.

BACKGROUND OF INVENTION

This invention relates to the field of hydrotherapy devices. More particularly, this invention relates to a hydrotherapy device having an adjustable speed treadmill with special lift and treadmill moving means and having an integrated control system.

Hydrotherapy devices for tanks and treadmills are disclosed in such patents as Leonaggeo, Jr., U.S. Pat. No. 4,918,766 and Keller, U.S. Pat. No. 5,108,088.

The instant invention is directed primarily for human use and as such requires special considerations. In particular it is desirable not only to lift the treadmill means within the tank so as to accommodate the various needs of the users, but also to provide an integrated moving means and control system. For example the apparatus for lifting the treadmill is preferably, and often, done by hydraulic means. However, because a hydraulic apparatus is normally located within the tank under the water, it is common for such systems, which leak, to easily contaminate the water supply via a leak or gasket deterioration. Further, the entry point of the moving means into the tank walls needs to be one that minimizes the risk of tank leakage at that point.

The instant invention utilizes means for lifting one end of the a treadmill in the tank. Whereas Leonaggeo discloses center scissor lift means, the instant invention utilizes a chain drive to lift the tank utilizing a single scissor lift means, and while doing so, utilizes the same pivot point of the single scissor assembly as a common belt and pulley type arrangement for providing the motivating force to run the treadmill as well. Consequently not only is the treadmill lifted from the end in a special single scissor arrangement, the treadmill moving means utilizes the same pivot points in conjunction therewith.

It is common in hydrotherapy systems to utilize jets. However, to control the rate of flow of water from the jets, rather than utilizing valves that open and close manually, an AC inverter means is used to run the pump so as to allow the pump to be run electronically and adjusted so that the output of the pump can be controlled electronically.

It is also an objective to monitor and control the water chemistry and to do so in combination with controlling other functions of the apparatus. An integrated control system is provided to control not only the water chemistry but the treadmill height, speed, jet functions and other functions of the apparatus and to do so in an integrated fashion with a computer so as to electrically isolate the person from the system and to further enable, with existing PC computers, the operator to do so utilizing commonly available infrared remote control units. The infrared remote control unit controls the computer which controls all functions of the apparatus described above.

It is further an object of the invention to provide safety features, including not only the isolation of the system's electrical or other control apparatus from the operator, but also provide compatible safety emergency switches.

It is a further object of the invention to provide a treadmill with adjustable impact absorption means so as to adjust the treadmill floor to provide various impact results to speed the recovery of the patient depending on the patient's needs. Impact adjustment means allow for softening the impact of the foot on the treadmill.

Consequently, it is an object of the invention to provide a hydrotherapy device having an adjustable speed treadmill with end lift means so as to easily access the lifting apparatus. It is further an object of the invention to provide an adjustable speed treadmill and to provide such an apparatus in a manner so as to maximize the cleanliness of the water and to do so in conjunction with the lifting means. It is a still further object of the invention to provide integrated monitoring and control means of the water chemistry and the treadmill movement as well as the jet movement, and to electronically control the water jet means so as to allow the operator to control the system from one computer and to alternatively control the system from a relatively inexpensive infrared remote. It is a further object of the invention, in conjunction with the other apparatus described and in conjunction with the other objects, to provide adjustable impact absorption means and emergency safety devices. It is further an object of the invention to do all of the above in an economically feasible manner and in a manner so as to minimize the possibility of leakage and the possibility of contaminating the water supply.

Other objects and features of the invention and the manner in which the invention achieves its purpose will be appreciated from the foregoing and the following description and the accompanying drawings which exemplify the invention, it being understood that changes may be made in the specific method and apparatus disclosed herein without departing from the essentials of the invention set forth in the appended claims.

DESCRIPTION OF THE PREFERRED EMBODIMENT

Figure 1:
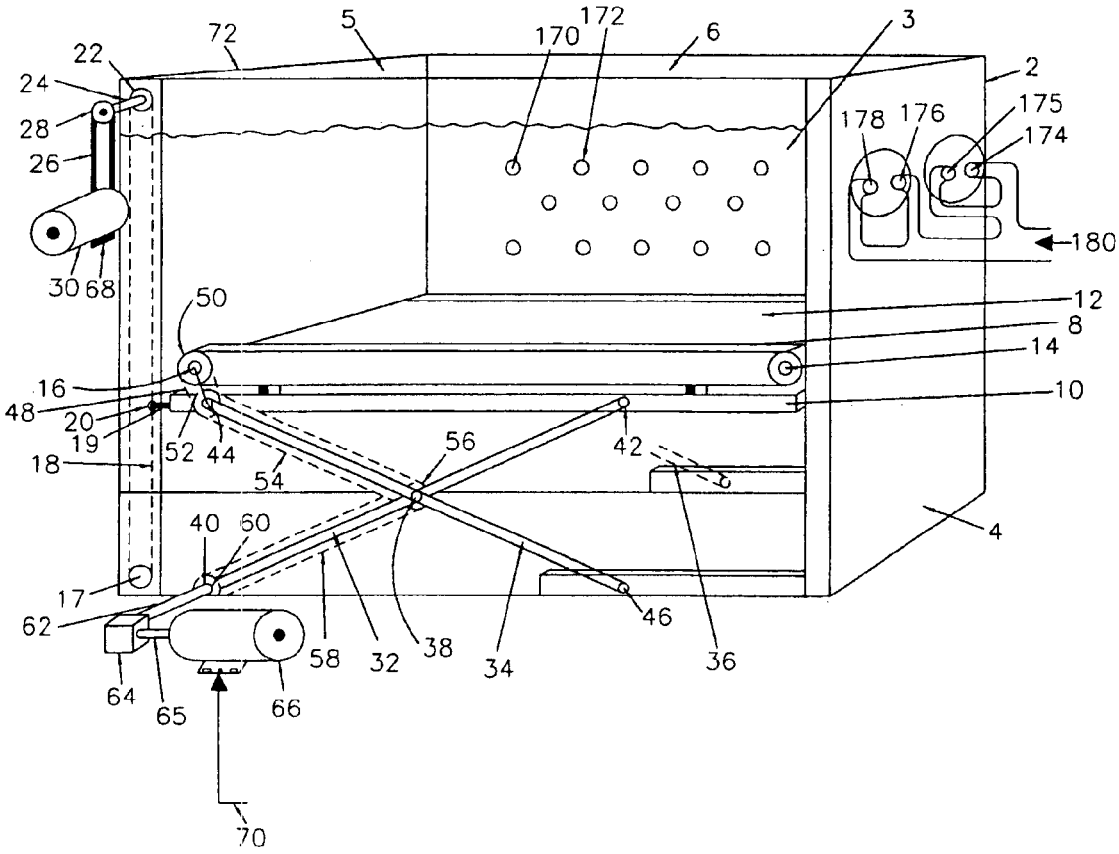
FIG. 1 is an overall perspective view of the invention shown without the front wall thereon.

The invention is shown in the preferred mode in FIG. 1. The tank 2 is shown holding water 3 at a water level line. The tank has a front end 4 and an opposing rear or back end 5. The sidewall 6 has an opposing sidewall (not shown in order to disclose the interior elements and features). The treadmill 8 is shown atop a supporting platform 10 and has a treadmill belt 12 rotating about the treadmill ends 14 and 16.

The treadmill is preferably fixed upon the platform 10 and moves up and down in the water as the platform is moved. The vertical movement of the platform is accomplished by attachment to the chain 18 at 20. The chain rotates about the sprockets 22 and shaft 24 which itself is turned by chain 26 and sprocket 28, which itself is turned by motor 30. The motor 30 is an electric motor however other end lift means, other than the motor, chain and sprocket assembly as disclosed, including hydraulic or pneumatic and lift means, are envisioned for lifting the platform 10 at 20.

Additional support for the platform is provided by rigid members 32 and 34. These rigid members are pivotably joined at the center 38. Member 32 has a fixed end nearest the rear of the tank at 40 and is pivotably connected as will be seen further in FIG. 2. The opposing end of member 32, also described herein as the distal end, is horizontally slidably attached to the platform at 42. Rigid member 34 similarly has a fixed end at 44 pivotably attached to the platform 10 at the rear end of the platform 10. The distal end of rigid member 34 is, like the distal end of rigid member 32, horizontally slidably attached at 46 near the bottom and front of the tank.

This chain and sprocket assembly described and the two rigid members described also exist nearest the opposing wall 6 and is shown only in part as dotted portion 36 for clarification only. However it should be understood that while the invention works best with dual systems, the system can also work and is envisioned with a single system on one side or the other as shown or in the middle of the rear end wall. Further structural integrity is achieved with a dual system however.

Figure 3:
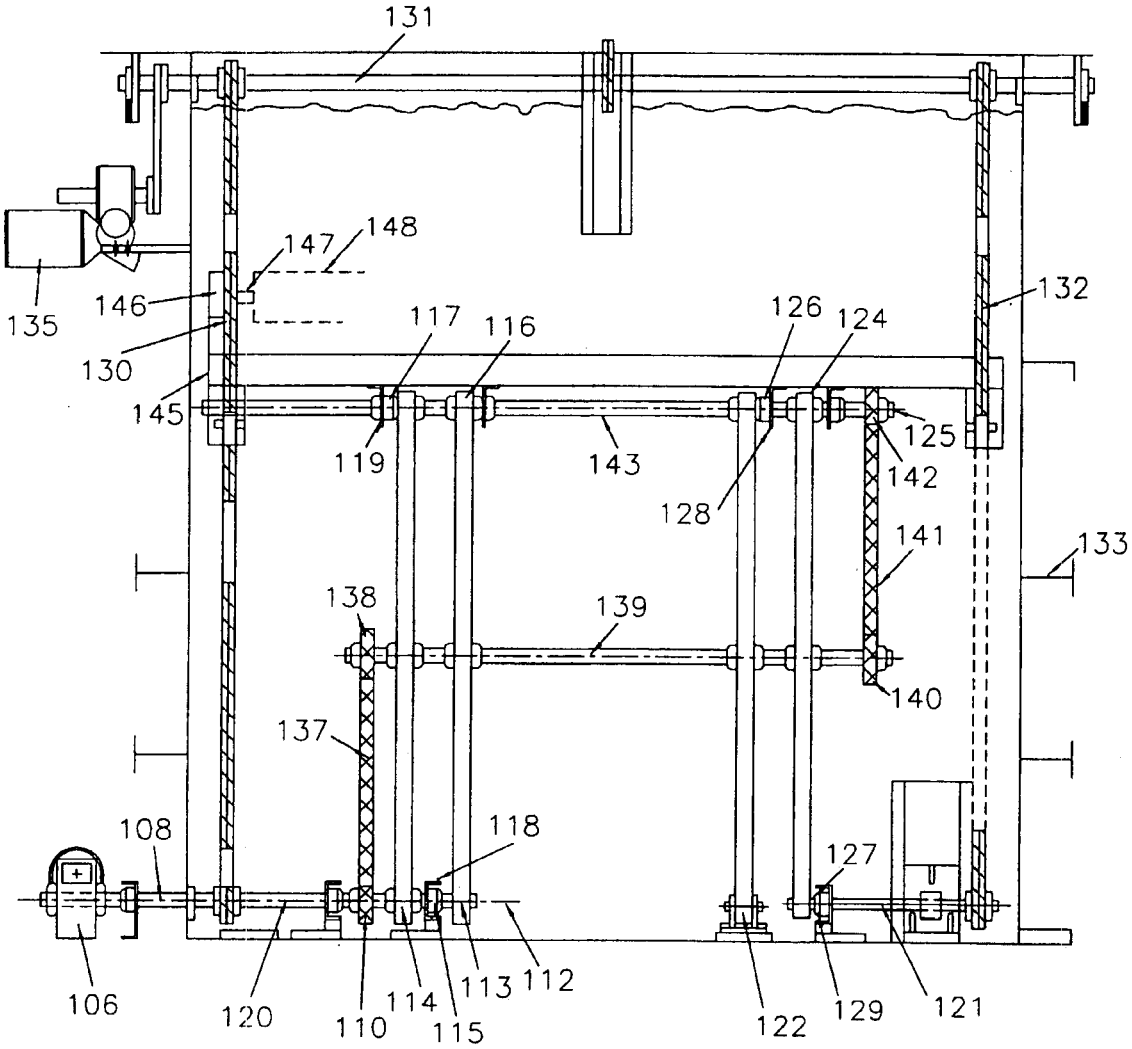
FIG. 3 is an end view of the invention.
Figure 4:
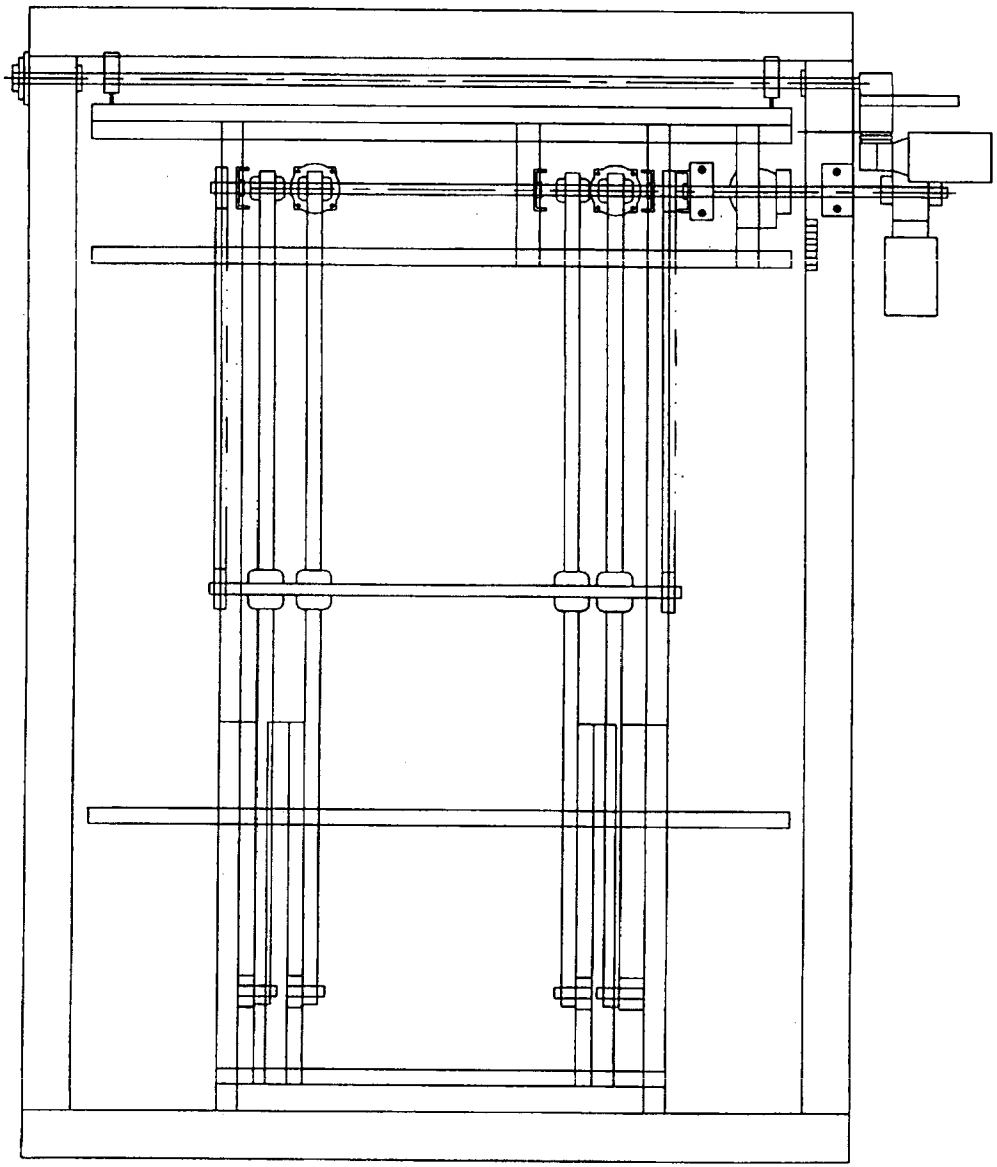
FIG. 4 is a top view of the invention.

The rotation of the conveyor treadmill about the pivot point 16 is accomplished by a series of flexible links comprised, in the preferred mode, of belts and pulleys however any similar type arrangement including chains and sprockets, grooved belts and grooved pulleys or other flexible link arrangement is envisioned. The first link is accomplished via belt 48 linking pulleys 50 and 52 at pivot points 16 and 44 respectively. Pulley 52 is shown attached to another pulley at 44 that comprises one end of a flexible link linked via belt 54 to opposing end 50 and pulley 56. However, an alternative mode exists on the support system nearest the opposing wall 6 via shafts as shown in FIGS. 3 and 4. Consequently the system in the latter instance is more easily balanced and accessible for replacement of belts. Transfers of energy from one side of the treadmill to the other and back are accomplished via the shaft shown in FIGS. 3 and 4.

Continuing with the mode of the invention shown in FIG. 1, a final flexible link is shown with belt 58 rotating about the pivot point 56 with the pulley 60 rotating about pivot point 40. The shaft 62 connects the pulley 60 with the gear box or gear reducer 64 to the electric motor 66 via shaft 65. Other mode of forces are envisioned for the electric motor 66 with electric motor gear box and shaft assembly 62, 64, 65, and 66.

Figure 7:
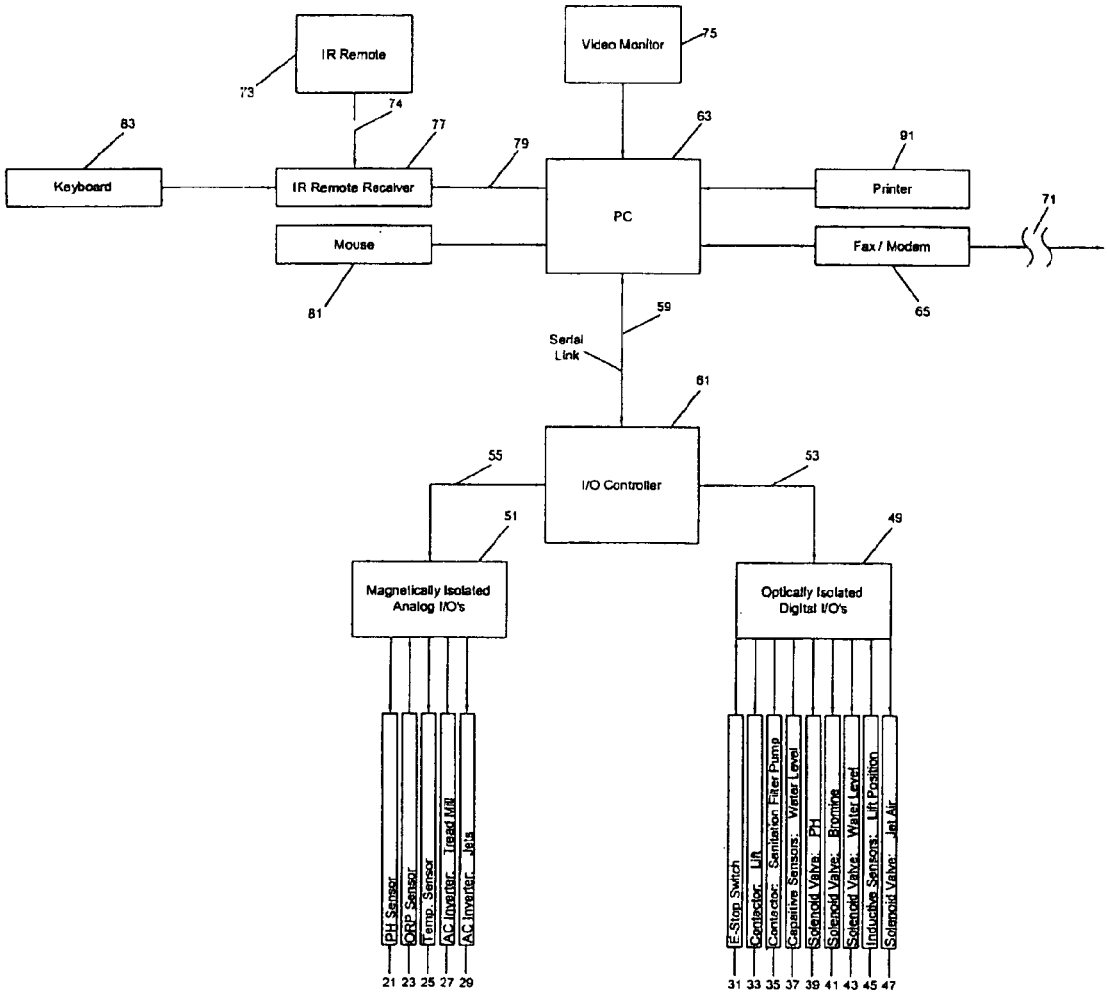
FIG. 7 is a block diagram of the Control System for the Tank, Treadmill and Lift Apparatus.
Figure 8:
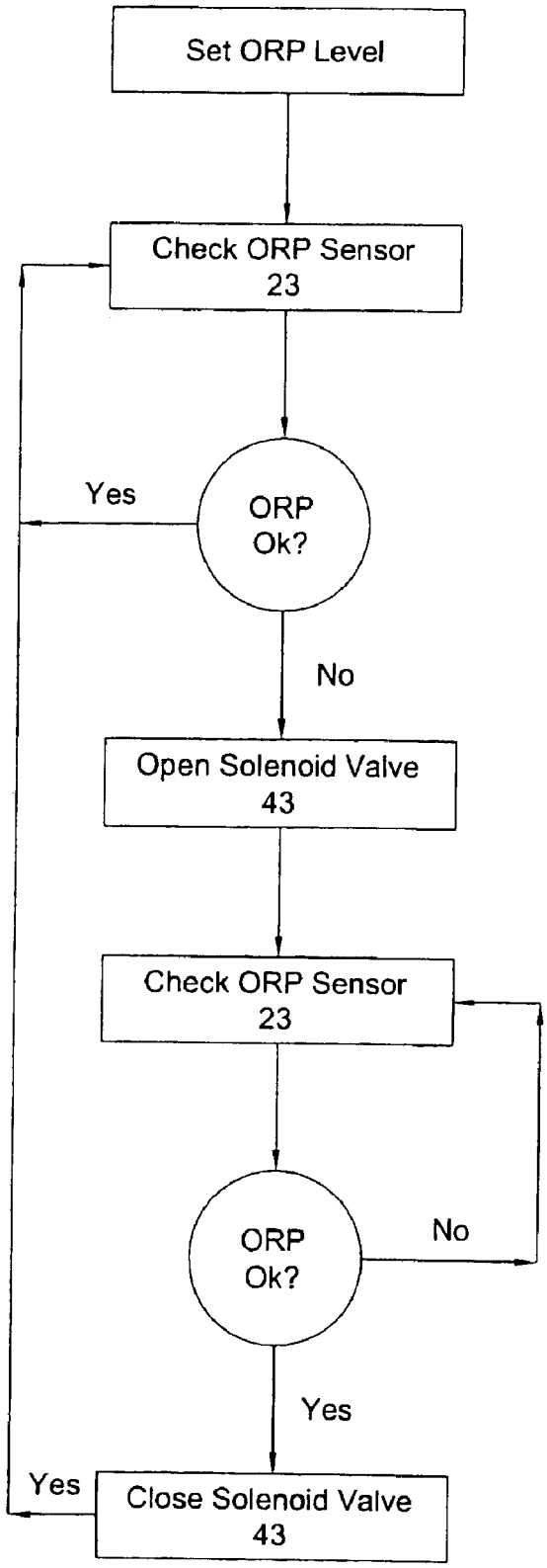
FIG. 8 is a flow chart showing the sequential logic for one branch in the multitasking control system.

Consequently, the motor ultimately turns the shaft 60 and through the three flexible links described, transfers energy to the pulley 50 thus turning the treadmill conveyor. All of the above is accomplished utilizing the same pivot points as created by the two rigid structure members combined. The motor 66 and the motor 30 are controlled by electrical signals at 70 and 68 respectively. The signal 70 controls the speed of the motor as does the signal 68. Both signals at 68 and 70 are generated from the control microprocessor as shown in FIG. 7.

It will also be seen that the water 3 penetrates the wall section between interior wall 5 and exterior end wall 72 and that the chain and sprocket assembly 18, 22, and 17 is inside the unit in the water and consequently water tight seals at 22 and 17 as well as at 40 are necessary. However the invention is designed in this manner so as to provide for apparatus that will most easily allow water tight seals through the enclosure. Moreover, the support structure (rigid members 32 and 34) allow for least contamination of the water by the mechanical system. Other devices provide for hydraulic mechanisms inside the tank, an undesirable structure inasmuch as hydraulics allow for leaks of the fluid and in a therapeutic environment is unclean and entirely undesirable. Consequently the support structure and the lifting structure, are not unique in themselves but provide for a far more hygienic system.

Figure 2:
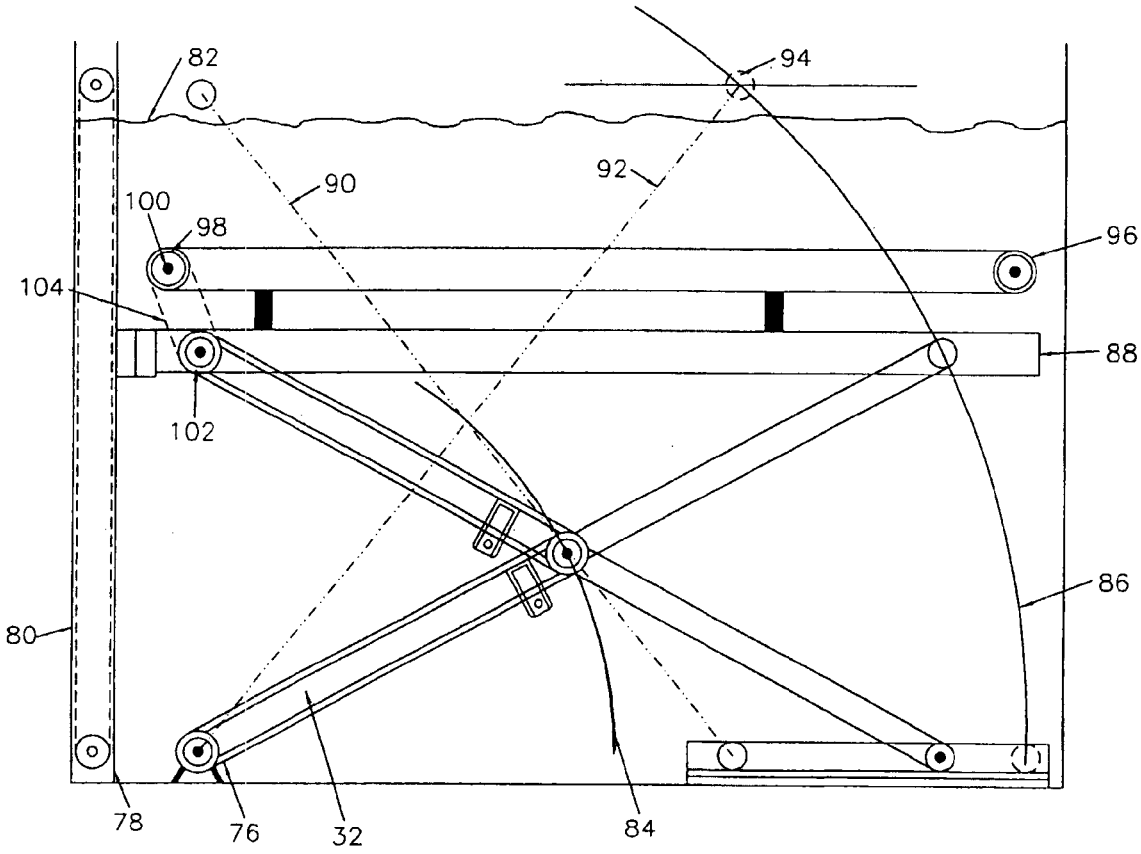
FIG. 2 is a side view of the invention.

The side view in FIG. 2 shows the fixed point at which the rigid member 32 is fixed. Also the inside wall 78 is shown though as indicated earlier, the chain and sprocket mechanism 80 is normally immersed in water as shown by the water line 82. The arcs 84 and 86 show the movement of the pivot points on the rigid members during the raising and lowering of the platform 88. The dotted lines 90 and 92 show the position of the rigid members in a raised position when the platform would be located at 94. The treadmill 96 is shown having pulley 98 rotating about the pivot point 100 as one end of a pulley in the fixed link connecting the opposing pulley 102 via link 104.

FIG. 3 shows the end view utilizing the fixed links and shaft discussed earlier. The treadmill motor 106 transfers its rotational energy via shaft 108 to the fixed link at 110 connected to the common pivot point at 114 as determined by the common axis 112. The pivot point at 114 is the fixed end of the one rigid member nearest the rear end. The fixed end of the adjacent rigid member is shown at 116. The opposing ends of the two rigid members are attached to rotating wheels 117 and 115 that slide horizontally in channels 119 and 118. The shaft 120 is shown as a separate shaft from that shaft 121; in practice the two shafts are in the same place. As similar to that discussed previously, the fixed end of the rigid member nearest the rear end in the opposing set of rigid member structures is shown at 122. The fixed (but as before rotatable) end of the adjacent rigid member is located at 124, rotating about the common axis 125. The distal ends of the two respective rigid members likewise are attached to rotating wheels 126 and 127 in channels 128 and 129.

The chain 130 is shown attached to a common rotating shaft 131 which also transfers energy to the opposite chain 132. Support structures 133 are shown for structural support in the walls.

The flexible link via belt 137 attached to pulley 138 transfers energy to the shaft 139 which extends through the common pivot points of all four rigid members to the pulley 140 which consequently transfers rotational energy through the flexible link via belt 141 to the pulley 142. That pulley then transfers rotational energy through the shaft 143 to the final flexible link via belt and pulley arrangement 145 to the pulley 146 which transfers rotational energy to the conveyor of the treadmill 148.

The top view is shown in FIG. 4 which likewise shows the system of belts and pulleys and flexible links as described in FIG. 5.

Figure 5A:
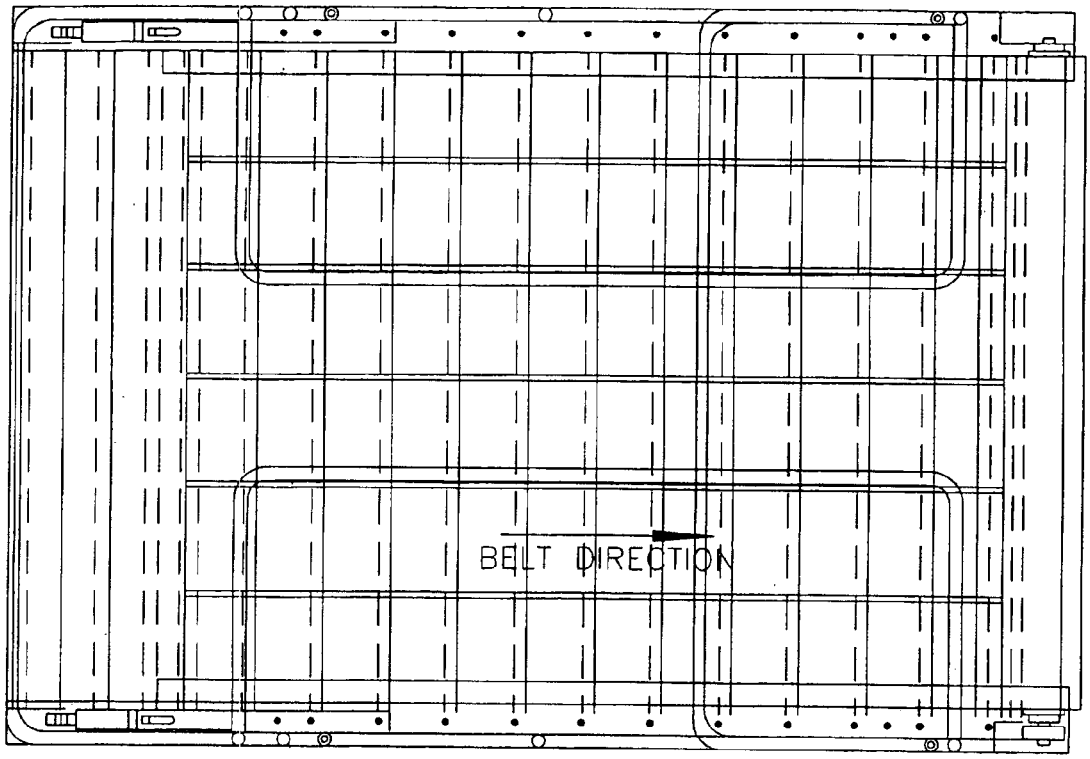
FIG. 5*a* is a top view of the treadmill alone.
Figure 5B:
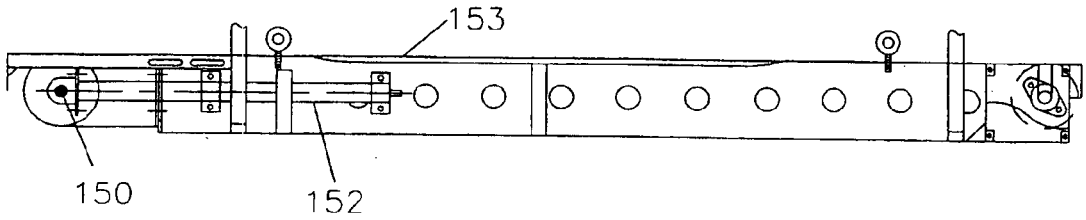
FIG. 5*b* is a side view of the treadmill.

FIGS. 5*a* and 5*b* show the treadmill and the belt direction along with a side view. The belt revolves around pivot point 150 which pivot point corresponds to the pivot point 100 in FIG. 2 and corresponds to the common pivot point of the pulley 146 in FIG. 3. Also shown in FIG. 5*b* is the belt tensioning device assembly 152 which provides for adjustable means for providing tension in the conveyor 153 via adjustable spring loaded means.

Figure 6:
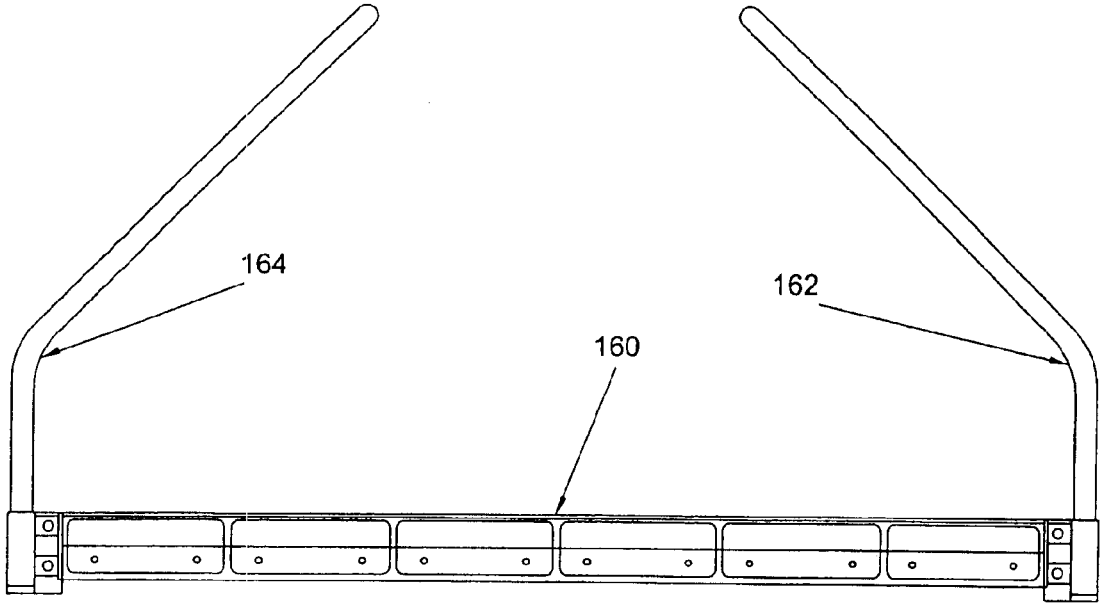
FIG. 6 is an end view of the treadmill as shown with the handrail attachments.

The treadmill is shown in FIG. 6 as 160 with handrailing 162 and 164 fixed to the sides of the treadmill.

In use, the treadmill operator controls the level and status of the system preferably before the user enters, utilizing the keyboard 83 and/or IR remote control 77, shown in FIG. 7, to send the appropriate signals through the microprocessor system. Consequently the signals are sent to raise or lower the lift via contactor 33, which is connected to the lift motor 30 at 68. The status of the water quality is determined by the desired chemical sensing means and the appropriate signals sent to the appropriate desired chemical control means to adjust the water chemistry. Once the user is in the water, standing on the treadmill, it is then common to start the treadmill moving by sending the appropriate signal through the microprocessor system to the treadmill AC inverter which accordingly starts the treadmill moving. The speed of the treadmill is likewise monitored and shown on the microprocessor and appropriate adjusting signals are sent to speed up or slow down the treadmill. The user typically faces the front end. The jets 170, 172 (and associated jets in the side wall 6), 174, 175, 176 and 178 are turned on by controlling the water flow at 180 through the water pump, controlled by the AC inverter. By controlling the electric power to the pump, the amount of water pumped, consequently the flow rate, is controlled so that the water flows through fast or slow as desired.

During the use of the system, as the water chemistry and conditions change with the user in the water during exercise, the system automatically monitors them through the various sensing devices described and the user can monitor them as well on the monitor and change them utilizing the infrared remote control means. Likewise, if it is desirable in use to lower or raise the treadmill, simply pressing the appropriate buttons on the infrared remote control sends the appropriate electrical signals to control the motor 30.

FIG. 7 shows a control system for sensing and controlling the tank, water and treadmill system. The system has water sensing and control means, means for sensing and controlling other functions, as well as isolating the system from the individual the system and from the computer for safety and other reasons.

As shown, the system, in the preferred mode, senses the quality of the water through the pH sensor, the ORP (oxidation reduction potential) and the temperature through sensors 21, 23 and 25. Said sensors gather data converting it to analog electrical signals and send the signals to the input/output 51. Likewise, the speed of the treadmill is monitored and controlled by AC invertor 27, and the flow water through the jets is controlled by the pump AC invertor 29. Both the treadmill AC invertor and the jet AC invertor send and receive, as opposed to just send, signals to and from the input/output 51.

The emergency stop switch 31 is connected to the input/output 49 such that if the stop switch is pulled or operated, the signal is immediately sent to the system shutting down the system. The lift status may be monitored but in the preferred mode here, the lift contactor 33 is only a receiving device to receive signals from the input/output 49. The sanitation/filter pump 35 also receives a control signal from the input/output 49. The water level is controlled by solenoid valve 39 and receives a signal from the input/output 49. The pH level is controlled by the solenoid valve 41 which receives a signal from its control signal from 49. Likewise the bromine content is controlled via solenoid valve 43 which likewise receives its signal from input/output 49. The water level is sensed via capacitive or other sensors 37 and sends its signals to the input/output 49. The position of the lift is sensed using inductive sensors 45 and electrical signals are sent to input/output 49. The jet air is controlled by solenoid valve 47 via signals from input/output 49.

All of the electrical signals from the aforementioned sensors and devices 21, 23, 25, 27, 29, 31, 33, 35, 37, 39, 41, 43, 45, 47 are electrical signals that can be either analog or data but in the preferred mode are shown either analog or data signals. Consequently input/output 49 is a digital device and input/output 51 is an analog device. The digital input/output devices are, in the preferred mode, optically isolated such that the electrical signals received are, internally, converted to electrical signals, transmitted as optical signals, received as optical signals and decoded and retransmitted to electrical signals at the outputs. The optical transmission operates in both directions in the input/output device. Optical here includes not only visual wavelength light but all lightwave frequencies visual, infrared, ultraviolet, or otherwise. Optical isolation in this manner, in an wet environment such as this, allows further safe isolation of the operator from the water and electrical power of the machinery, and also provides for more secure and certain communications free of outside electrical interference. Other electrical protection means are envisioned including magnetic. The analog input/output devices are, in the preferred mode, magnetically isolated such that the electrical signals received are internally electrically separated from the signals transmitted.

The input/output devices 49 and 51 send and receive signals through the input/output controller 61 via data paths 53 and 55. The input/output controller is a microprocessor device itself although in the preferred mode it is shown connected to another microprocessor device 63 through link 59. The system is set up so that 63 is a commonly available personal computer having storage means for storing the data received from the sensing devices, printing means 91 for analyzing data results of the system status, video monitor 75 for observing the system status, keyboard means 83 and infrared remote means 73 and 77 to communicate and control the microprocessor 63 (and ultimately the input/output controller 61) via link 79. 79 consequently is a non-hardwired connection so as to even further isolate the operator and provide freedom of movement in dealing with the user of the system and controlling the system. Fax/modem 65 allows control and maintenance of the system from still further remote sources via phone, network or other long distance means.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

We claim:

1. An aquatic therapy tank apparatus for holding water and having jets of water injected into the tank at a desired water flow rate for providing aquatic therapy and exercise, comprising:

a. A tank for retaining water, said tank having a front end, a back end, two opposing sides, and a bottom affixed to the ends and sides so as to allow it to hold water;

b. Elongated treadmill means in said tank situated between the front end and back end with driving means for rotating the treadmill and having means, said driving means comprised of rotational motor means, for adjusting the speed of rotation;

c. Elongated platform means for supporting the treadmill means, said platform means having a front end near the front end of the tank, and a back end near the back end of the tank;

d. Lifting means slidably attached to the platform for supporting and lifting the platform and treadmill means, comprised of at least two elongated rigid supporting members, each such member having two opposing ends, one member having one end slidably connected to the platform and the opposing end affixed and pivotably connected to the tank near the rear end of the tank to create a first pivot point, and the other elongated rigid member having one end slidably connected to the tank near the bottom and having the opposing end affixed and pivotably connected near the rear end of the platform to create a second pivot point, and wherein the two elongated rigid members are pivotably connected to each other near the center at a center pivot point;

e. Linkage means rotationally linking the rotational motor means to the treadmill utilizing at least one of the pivot points.

2. The aquatic therapy tank apparatus in claim 1 wherein the treadmill driving means is comprised of rotational motor means connected to a first flexible linkage having a first end and second end about which the linkage rotates, said first end rotatably connected to the rotational drive means, and the second end connected so as to rotate about the center pivot point of the treadmill rigid members, and a second flexible linkage having two ends about which said flexible linkage rotates, a first end rotatably connected to the center pivot point, and a second opposing end rotatably connected to the end of the rigid member pivotably connected to the front end of the platform, and a third flexible linkage having a first and second end, said first end pivotably connected to the second end of the second flexible means, and said second end pivotably connected to one end of the treadmill so as allow rotation of the treadmill.

3. The aquatic therapy tank apparatus in claim 2 wherein the tank has a plurality of jet nozzles in at least one side through which water flows at the desired rate of flow into the tank, and having means for adjusting said water flow rate control means comprised of a water pump pumping at a rate responsive to the amount of electrical current to the pump and having means for adjusting the amount of electrical current provided to the pump.

4. The aquatic therapy tank apparatus in claims 1, 2, or 3 having means for monitoring the speed of the treadmill, means for monitoring the desired chemical requirements of the water, means for adjusting the chemical requirements of the water, means for monitoring the rate of water flow and means for electronically adjusting the same, memory and electronic microprocessor means for recording and adjusting said monitored items, and having remote control means for operating the microprocessor control system to allow operation of the system for inside the tank.

5. The aquatic therapy tank apparatus in claims 1, 2, or 3 having water therein with a predetermined chemical composition and having electrical means for sensing electrical signals representing the status of at least one of the elements of speed of the treadmill, chemical content of the water, and rate of water flow, and having means for sending corresponding electrical signals representing said respective status signals, means for electrically isolating the sensing means from the microprocessor control means, means electrically connected to the microprocessor for storing said data, output means connected to the microprocessor for sending control signals responsive to each of the monitored sensing means, means for effecting the system status in response to the electrical control signals, and means for isolating electrical sensing means for effecting the system status.

* * * * *